US008156881B2

(12) United States Patent
Ozaki et al.

(10) Patent No.: US 8,156,881 B2
(45) Date of Patent: Apr. 17, 2012

(54) STEERING HANDLE UNIT OF WATERCRAFT

(75) Inventors: Taishi Ozaki, Yokohama (JP); Yoshiki Futaki, Itawa (JP)

(73) Assignees: NHK Teleflex Corporation, Yokohama-Shi (JP); Yamaha Hatsudoki Kabushiki Kaisha, Iwata (JP)

( * ) Notice: Subject to any disclaimer, the term of this patent is extended or adjusted under 35 U.S.C. 154(b) by 188 days.

(21) Appl. No.: 12/495,968

(22) Filed: Jul. 1, 2009

(65) Prior Publication Data

US 2010/0000458 A1 Jan. 7, 2010

(30) Foreign Application Priority Data

Jul. 2, 2008 (JP) ..... 2008-173763

(51) Int. Cl.
*B63H 25/04* (2006.01)
*B63H 25/10* (2006.01)
*B62D 1/18* (2006.01)

(52) U.S. Cl. ..... 114/144 R; 74/493

(58) Field of Classification Search ..... 114/144 R, 114/55.52; 74/492, 493, 551.3; 292/34, 292/257, 270, 334
See application file for complete search history.

(56) References Cited

U.S. PATENT DOCUMENTS 5,813,289 A * 9/1998 Renick et al. ..... 74/493
6,055,922 A * 5/2000 Madachi et al. ..... 114/144 R
6,202,584 B1 * 3/2001 Madachi et al. ..... 114/144 R
7,213,484 B2 * 5/2007 Sawada ..... 74/493
7,559,576 B1 * 7/2009 Honkala et al. ..... 280/775
2001/0011693 A1 * 8/2001 Butterfield et al. ..... 248/188.5
2004/0261564 A1 * 12/2004 Sato ..... 74/492
2008/0264196 A1 * 10/2008 Schindler et al. ..... 74/493
2010/0018342 A1 * 1/2010 Curtin et al. ..... 74/551.3

FOREIGN PATENT DOCUMENTS

JP 11-348888 A 12/1999
JP 2006-56391 A 3/2006

* cited by examiner

*Primary Examiner* — Daniel Venne
*Assistant Examiner* — Anthony Wiest
(74) *Attorney, Agent, or Firm* — Holtz, Holtz, Goodman & Chick, PC

(57) ABSTRACT

A steering shaft is rotatably supported on a body by a housing, and a slide portion having a handlebar attachment portion at the top is attached to the steering shaft. The rotational movement of a handlebar around the central axis of the steering shaft is regulated by a rotation regulating mechanism, while the axial translation of the handlebar is allowed. The steering shaft is provided with a plurality of grooves. A lock mechanism provided in the slide portion inserts a locking bar into any one of the grooves to regulate the axial translation of the slide portion. Owing to the shape of a link portion and a cam groove constituting the lock mechanism, the locking bar is not pulled, out of the groove by operations other than a release operation using a release lever.

3 Claims, 5 Drawing Sheets

STEERING HANDLE UNIT OF WATERCRAFT

CROSS-REFERENCE TO RELATED APPLICATIONS

This application is based upon and claims the benefit of priority from prior Japanese Patent Application No. 2008-173763, filed Jul. 2, 2008, the entire contents of which are incorporated herein by reference.

BACKGROUND OF THE INVENTION

1. Field of the Invention

The present invention relates to a steering handle unit of a watercraft, and more particularly, it relates to a telescopic mechanism of a steering shaft.

2. Description of the Related Art

In steering a watercraft, a suitable position of a handlebar varies depending on the individual operator's constitution or preference and depending on the steering posture, for example, whether the operator is seated or standing. There has thus been proposed a steering apparatus capable of changing the position of the handlebar of a watercraft.

For example, a steering handle unit of a watercraft has been disclosed which has an angle adjustment mechanism capable of changing the tilt angle which is the angle of inclination of a steering shaft (Jpn. Pat. Appln. KOKAI Publication No. 11-348888).

According to this device, the angle of a handlebar can be changed, but the amount of movement in the front-back direction with respect to the operator is small. Depending on the constitution or posture including a standing posture, the operator may lean forward while steering which could be uncomfortable.

According to a steering apparatus disclosed in Jpn. Pat. Appln. KOKAI Publication No. 2006-56391, a knob, for example, is turned to turn a worm-like member provided on the shaft of the knob. Then, a worm rack which is toothed with the worm-like member moves such that a steering position can be changed along a direction which is inclined backward with respect to the rotation shaft of a steering shaft.

In this apparatus, the knob, for example, is used to turn the worm-like member in order to change the position of a handlebar as described above. This may create a slight delay and extra force while changing the handlebar position.

BRIEF SUMMARY OF THE INVENTION

It is therefore an object of the present invention to provide a steering handle unit of a watercraft which enables an operator to operate a handlebar at an optimum steering handlebar position and which enables a rapid position change by a simple operation.

In order to achieve the object, the present invention provides a steering handle unit of a watercraft to operate a steering cable comprises: a housing attached to a body; a steering shall rotatably supported on the housing, the steering shaft having, at the bottom, an arm to which the steering cable is connected; and a slide portion which is attached to the steering shaft and which is translatable in the axial direction of the steering shaft, the slide portion having, sit the top, a handlebar attachment portion.

According to the present invention, an operator can operate the handlebar at an optimum steering handlebar position, and a rapid position change of the handlebar can be made by a simple operation.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
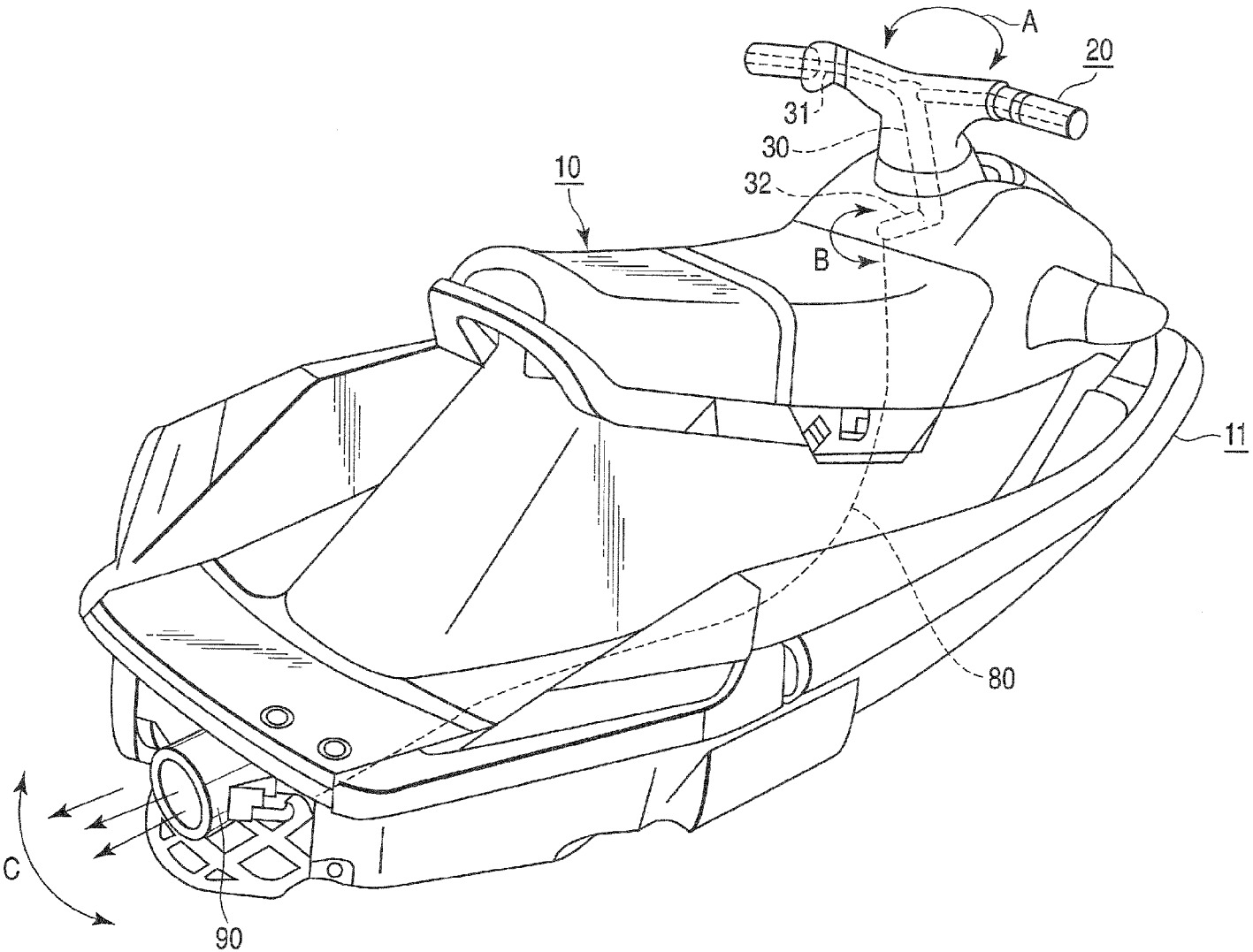
FIG. 1 is a perspective view showing a watercraft according to one embodiment of the present invention.
Figure 2:
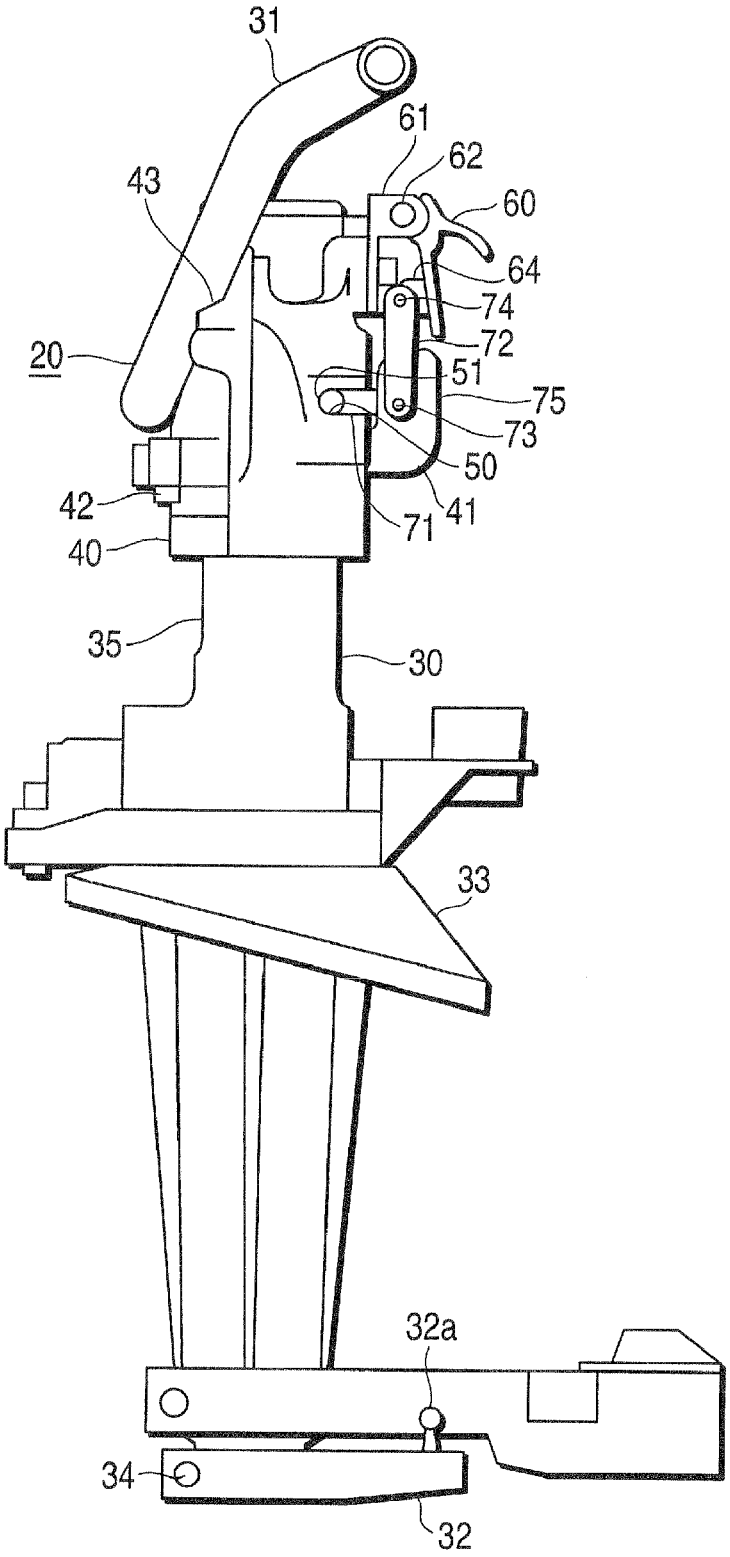
FIG. 2 is a side view showing a steering handle unit in the watercraft.
Figure 3:
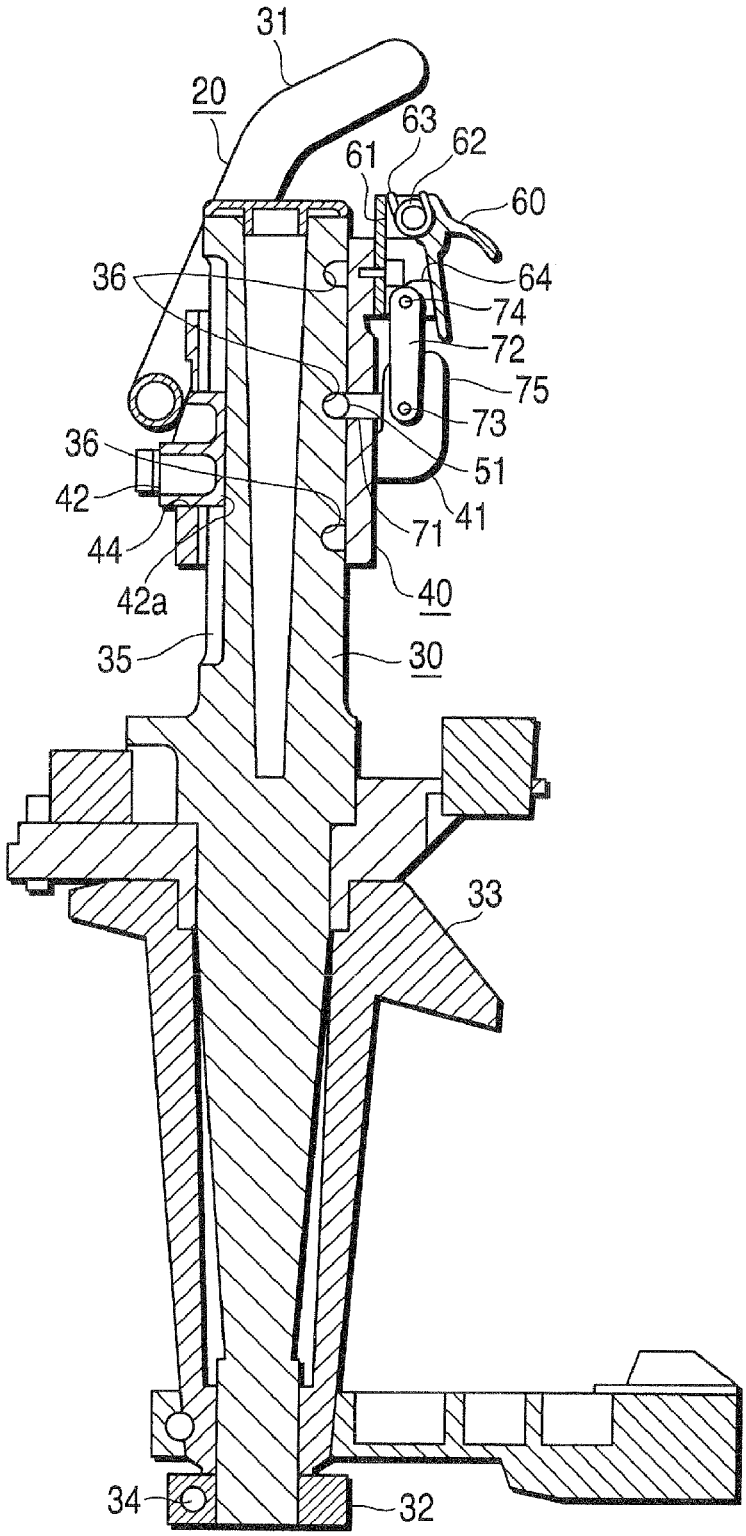
FIG. 3 is a sectional view showing a steering handle unit.
Figure 4:
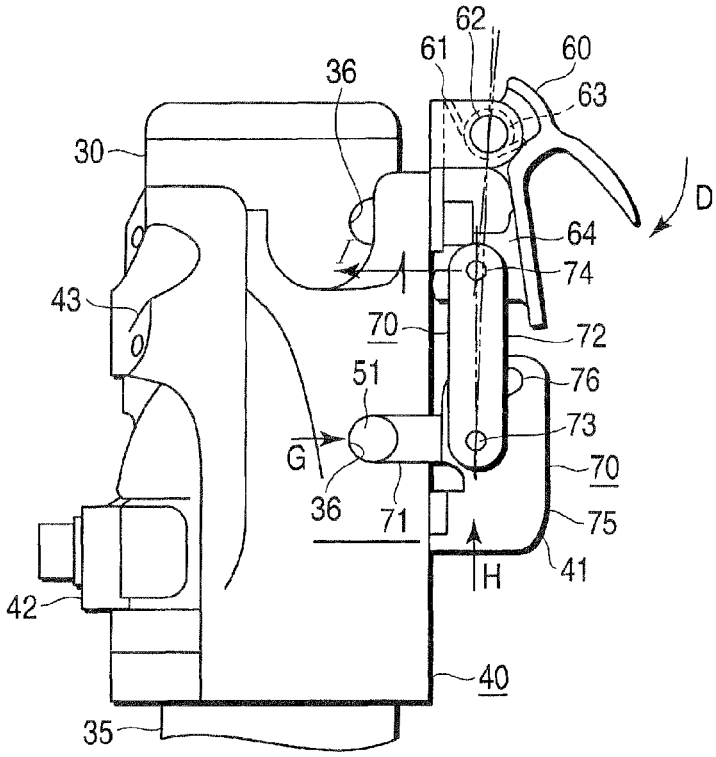
FIG. 4 is an enlarged view showing a part around a lock mechanism in the steering handle unit.
Figure 5:
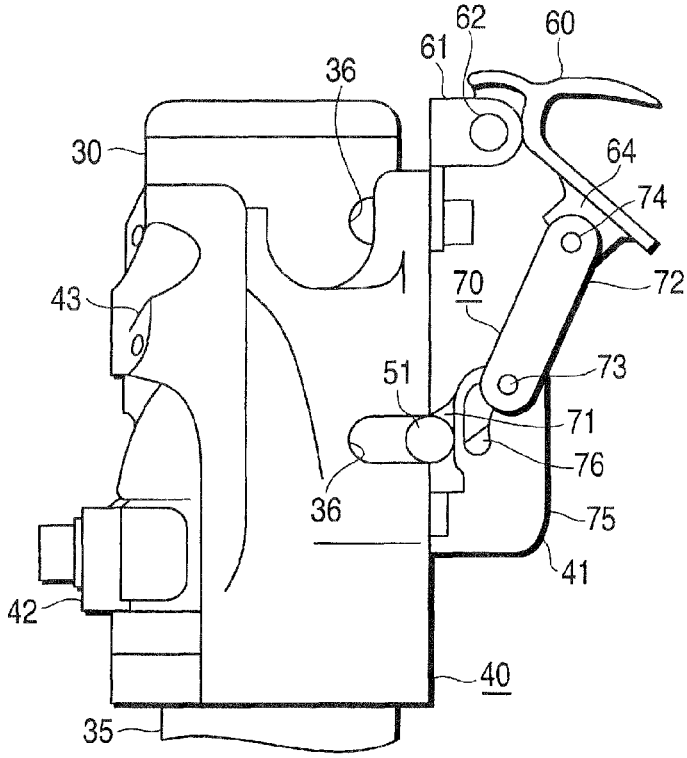
FIG. 5 is an enlarged, view showing the part around the lock mechanism when the lock mechanism is released.
Figure 6:
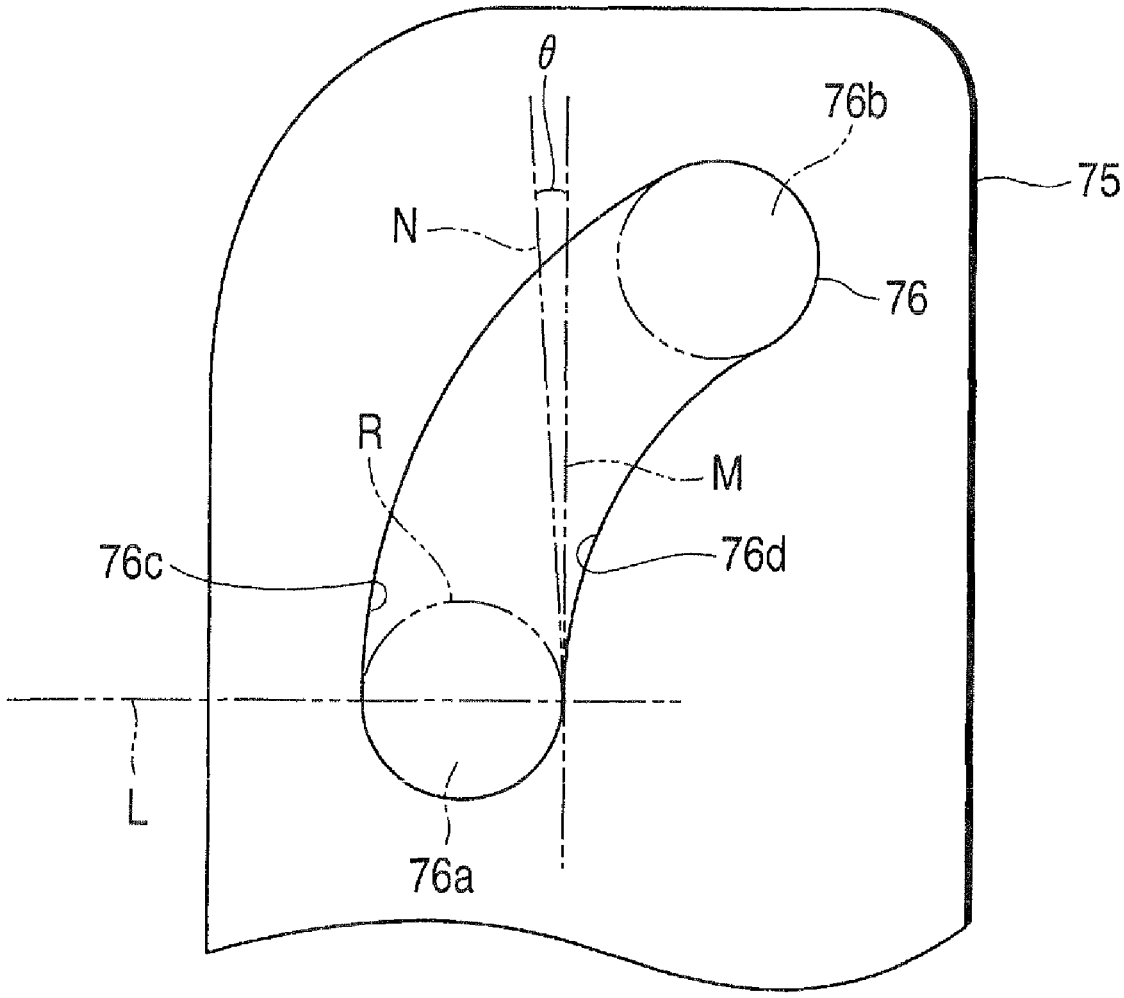
FIG. 6 is an enlarged view showing a part around a cam groove in the lock mechanism.

FIG. 1 is a perspective view showing a watercraft 10 having therein a steering handle unit 20 according to one embodiment of the present invention. FIG. 2 is a side view showing the steering handle unit 20. FIG. 3 is a sectional view showing the steering handle unit 20. FIG. 4 is an enlarged view showing a part around a lock mechanism in the steering handle unit 20. FIG. 5 is an enlarged view showing the part around the lock mechanism when the lock mechanism 41 is released. FIG. 6 is an enlarged view showing a part around a cam groove in the lock mechanism 41. The watercraft 10 comprises a body 11. In the front upper part of the body 11, the steering handle unit 20 is provided to project upward from the body 11.

The steering handle unit 20 includes a vertically provided steering shaft 30, and a substantially horizontally extending handlebar 31 provided on the top of the steering shaft 30 via a slide portion 40.

An arm 32 is a rod-like member extending in the diametrical direction of the steering shaft 30, and is attached to the lower end of the steering shaft 30 with a screw 34. A cable connecting portion 32*a* is provided at the end of the arm 32, and one end of a steering cable 80 such as a push-pull cable is connected to this cable connecting portion 32*a*.

The other end of the steering cable 80 is connected to a jet thrust nozzle 90 provided at the rear lower side of the body 11. The jet thrust nozzle 90 spouts water, and the propulsive force thus produced acts on the body 11 in the corresponding direction.

If an operator turns the handlebar 31 in the direction indicated by an arrow A, the steering shaft 30 and the arm 32 swivel in the direction of an arrow B accordingly. Thus, the steering cable 80 is pushed or pulled, so that the jet thrust nozzle 90 connected to the steering cable 80 turns in the direction of an arrow C. Due to the change of the water spouting direction associated with the change in the direction of the jet thrust nozzle 90, the traveling direction of the watercraft 10 changes.

A housing 33 is attached to the outer peripheral portion of the steering shaft 30, and this housing 33 supports the steering shaft 30 rotatably around its central axis. The housing 33 is installed on the body 11 so that the upper side of the steering shaft 30 is tilted backward at such a tilt angle as to be closer to the operator.

The slide portion 40 has a cylindrical shape covering the outer periphery of the steering shaft 30, and is provided on the upper side of the housing 33. The slide portion 40 includes the lock mechanism 41 for regulating the relative movement of the slide portion 40 and the sneering shaft 30, a rotation regulating mechanism 42 for regulating the rotational movement of the slide portion 40 around the central axis of the steering shaft 30, and a handlebar attachment portion 43 which is a groove for fitting in and fixing the handlebar 31.

The lock mechanism 41 is provided in the slide portion 40 on the rear side in the traveling direction of the watercraft 10. The rotation regulating mechanism 42 and the handlebar attachment portion 43 are provided opposite to the lock mechanism 41. The rotation regulating mechanism 42 is inserted into an attachment hole 44 provided in the slide portion 40, and fixed to the slide portion 40 with, for example, screws.

As shown in FIG. 3, the rotation regulating mechanism 42 has an engagement portion (rotation regulating portion) 42*a* projecting toward the inside diameter of the slide portion 40. The steering shaft 30 has a rotation regulating groove 35 on the surface facing the rotation regulating mechanism 42.

The engagement portion 42*a* is inserted in the rotation regulating groove 35. The rotation regulating groove 35 has a width slightly greater than the width of the engagement portion 42*a*. When the engagement portion 42*a* is inserted into the rotation regulating groove 35, the rotational movement the slide portion 40 around the central axis of the steering shaft 30 is regulated.

The rotation regulating groove 35 is provided to extend in the direction of the axis line of the steering shaft 30. The inserted engagement portion 42*a* and the slide portion 40 can freely translate in the direction of the axis line of the steering shaft 30 over the range where the rotation regulating groove 35 is provided.

The rotation regulating groove 35 is closed at the top and bottom in its axis line direction. When the slide portion 40 is moved upward in the axis line direction of the steering shaft 30, the rotation regulating groove 35 prevents the slide portion 40 from dropping from the steering shaft 30.

FIG. 4 and FIG. 5 are views showing the essential parts of the lock mechanism 41 in an enlarged form. FIG. 4 shows how the translation of the slide portion 40 in the axial direction is regulated by the lock mechanism 41. FIG. 5 shows how the free translation of the slide portion 40 in the axial direction is allowed by the operation of the lock mechanism 41.

The steering shaft 30 is provided with grooves 36 at a plurality of positions, and these grooves 36 are recesses perpendicular to the axis line direction of the steering shaft 30. The grooves 36 are provided in a direction corresponding to the lock mechanism 41.

The groove 36 has a semicylindrically curved bottom surface, and a cylindrical rod having a radius equal to the semicylindrical shape can be fitted into the groove 36.

The lock mechanism 41 includes a locking bar (lock component) 51, a release lever 60 attached to the outer side of the slide portion 40, and a link portion 70 which is interposed between the locking bar 51 and the release lever 60 and which interlocks the locking bar 51 with the operation of the release lever 60.

The locking bar 51 is a cylindrical rod having a radius that can be fitted into the groove 36. When the slide portion 40 is fixed as in FIG. 4, the locking bar 51 is inserted in one of the grooves 36. As a result, the movement of the slide portion 40 in the axis line direction of the steering shaft 30 is regulated.

A lever attachment portion 61 is attached to the slide portion 40 to project in the diametrical direction of the slide portion 40. The release lever 60 is attached to the lever attachment portion 61. The release lever 60 and the lever attachment portion 61 are linked, together by a lever insertion shaft 62 which is inserted through the release lever 60 and the lever attachment portion 61. The release lever 60 can be turned around the lever insertion shaft 62.

A return spring 63 which is a coil spring is wound around the outer periphery of the lever insertion shaft 62. The return spring 63 has its ends hooked to the release lever 60 and the lever attachment portion 61, respectively. Thus, the return spring 63 always applies force to the release lever 60 to turn around the lever insertion shaft 62 in the direction of an arrow D in FIG. 4.

The release 3 ever 60 has an integrally formed contact piece 64 at the end opposite to the lever insertion shaft 62. The contact piece 64 is a projection which projects in the direction of the slide portion 40, that is, toward the central axis of the steering shaft 30.

The contact piece 64 is shaped to have its end in contact with the outer peripheral surface of the slide portion 40 so that the release lever 60 turned by the return spring 63 may be a predetermined distance or more away from the slide portion 40.

The link portion 70 is configured as follows: One end of a first link bar 71 is fixed to the locking bar 51 with a screw (not shown). The other end of the first link bar 71 is turnably connected to one end of a second link bar 72 by a first insertion shaft 73 which is inserted in these two parts. The other end of the second link bar 72 is turnably connected to the contact piece 64 of the release lever 60 by a second insertion shaft 74 which is inserted in these two parts.

A cam plate 75 is attached to the outer periphery of the slide portion 40 to diametrically project from the central axis of the steering shaft 30. The cam plate 75 is shaped like a plate having a surface parallel with the central axis of the steering shaft 30, and has a cam groove 76 which is a curved hole.

The cam plate 75 is interposed between the first link bar 71 and the second link bar 72. The first insertion shaft 73 is inserted in the cam groove 76 between the first link bar 71 and the second link bar 72. If the link portion 70 is interlocked with the operation of the release lever 60, the first insertion shaft 73 moves along the cam groove 76.

FIG. 6 is a view showing the essential parts of the cam groove 76 in an enlarged form.

When the locking bar 51 is inserted in the groove 36 as shown in FIG. 4, the first insertion shaft 73 is located at a fixing position 76*a* of the cam groove 76.

When the locking bar 51 is completely pulled out of the groove 36 as shown in FIG. 5, the first insertion shaft 73 is located at a releasing position 76*b* of the cam groove 76.

An inner cam surface 76*c* is provided on the side of the slide portion 40 and an outer cam surface 76*d* is provided on the side far from the slide portion 40 so that the fixing position 76*a* and the releasing position 76*b* are linked together.

That is, the cam groove 76 has she fixing position 76*a*, the releasing position 76*b*, the inner cam surface 76*c* and the outer cam surface 76*d*, and the cam groove 76 is formed as a groove through the cam plate 75.

The cam groove 76 has the following unique shape around the fixing position 76*a*: A straight line L perpendicular to the central axis of the steering shaft 30 shown in FIG. 6 intersects at right angles with a tangent line M which is parallel to the central axis of the steering shaft 30 and which is on the outer side of a fixing position circle R forming the fixing position 76*a*.

A tangent line N to the fixing position circle R which passes a contact point between the fixing position circle R forming the fixing position 76*a* and the outer cam surface 76*d* has a slight angle θ of 0° or more with the tangent line M.

That is, a track extending to the releasing position 76*b* from the fixing position 76*a* at which the first insertion shaft 73 is interlocked with the operation of the release lever 60 is formed to protrude toward the slide portion 40.

Even when force as indicated by an arrow G in FIG. 4 is applied by the cam groove 76 formed as described above to push the locking bar 51 out of the groove 36, the first insertion shaft 73 does not move from the fixing position 76*a*.

In order to move the first insertion shaft 73 from the fixing position 76*a* to the releasing position 76*b*, it is necessary to apply force that moves the first insertion shaft 73 along the outer cam surface 76*d* which forms the track protruding toward the slide portion 40. That is, it is necessary to apply force to the first insertion shaft 73 in the vertical direction and in the direction of the central axis of the steering shaft 30.

Therefore, the link portion 70 is not moved and the locking bar 51 is not pulled out of the groove 36 simply by the force applied to the locking oar 51 in the direction of the arrow G.

Furthermore, the lever insertion shaft 62, the first insertion shaft 73 and the second insertion shaft 74 do not form one straight line as shown in FIG. 4. The second insertion shaft 74 is located inside a straight line which connects the lever insertion shaft 62 to the first insertion shaft 73.

The lock mechanism 41 formed as described above prevents the locking bar 51 from coming out of the groove 36 even when longitudinally acting force is applied to the second link bar 72 in the direction of arrow H in FIG. 4.

That is, if the force as indicated by the arrow H in FIG. 4 is applied to the second link bar 72, force acts on the second insertion shaft 74 in the direction of an arrow I in FIG. 4. Even if the force in the direction of the arrow I in FIG. 4 acts on the second insertion shaft 74, the end of the contact piece 64 contacts the outer periphery of the slide portion 40 so constrain the movement of the link portion 70.

Therefore, the link portion 70 does not move, and does not make any movement that causes the locking bar 51 to be pulled out of the groove 36.

The slide portion 40 having the above-described configuration operates as follows:

The translation of slide portion 40 in its axial direction is normally regulated by the lock mechanism 41 as in FIG. 4. If the operator raises the release lever 60, the contact piece 64 molded integrally with the release lever 60 also turns in the same direction. The second link bar 72 is raised by the second insertion shaft 74 inserted through the contact piece 64 so that she movement of one end of the second link bar 72 is guided by the cam groove 76 at the same time.

The first link bar 71 is pulled by the first insertion shaft 73 which is inserted through the cam groove 76 and which guides the movement of the second link bar 72. Thus, the locking bar 51 fixed at the end of the first link bar 71 is pulled out of the groove 36.

When the first insertion shaft 73 has reached the releasing position 76*b* of the cam groove 76, the locking bar 51 is completely pulled out of the groove 36 as in FIG. 5. Thus, the locking bar 51 does not regulate the translation of the slide portion 40 in the axis line direction any more, so that the operator can freely move the slide portion 40 up and down.

When the operator moves the slide portion 40 and depresses the release lever 60 at the position of the groove 36 to fix the slide portion 40, the lock mechanism 41 regulates the up-and-down movement of the slide portion 40 as follows:

When the operator depresses the release lever 60, the contact piece 64 molded integrally with the release lever 60 also turns in the same direction. The second link bar 72 is put down by the second insertion shaft 74 inserted through the contact piece 64 so that the movement of one end of the second link bar 72 is guided by the cam groove 76 at the same time.

The first link bar 71 is pushed out by the first insertion shaft 73 which is inserted through the cam groove 76 and which guides the movement of the second link bar 72. Thus, the locking bar 51 fixed at the end of the first link bar 71 is inserted into the groove 36.

When the first insertion shaft 73 has reached the fixing position 76*a* of the cam groove 76, the locking bar 51 is completely inserted in the groove 36 as in FIG. 4. Force is always provided to the lock mechanism 41 by the return spring 63 in the direction of the fixing operation as described above. Therefore, even if there are external factors other than the operation of the release lever 60 such as vibrations, rocking and rotation, the locking bar 51 is always subjected to the force in the direction to be inserted into the groove 36 and thus does not inadvertently come out of the groove 36. Thus, the locking bar 51 regulates the translation of the slide portion 40 in the axis line direction, and prevents the slide portion 40 from freely moving up and down.

In addition, when the release lever 60 is down, the insertion position of the locking bar 51 may be slightly different from the position of the groove 36. As the locking bar 51 is cylindrically shaped, the locking bar 51 is smoothly inserted into the groove 36 if the slide portion 40 is slightly shifted up and down.

Moreover, when the release lever 60 is down, the insertion position of the locking bar 51 may be considerably different from the position of the groove 36. Force is always applied to the locking bar 51 by the return spring 63 in the direction to be inserted into the groove 36. Thus, if the release lever 60 is kept down and, at the same time, the slide portion 40 is moved up and down, the locking bar 51 is automatically inserted into the groove 36 when the position of the locking bar 51 coincides with the position of the groove 36.

As described above, according to the steering handle unit 20 of the watercraft in the present embodiment, the operator can operate the handlebar at the optimum handlebar position and can rapidly change the position of the handlebar by a simple operation. Moreover, the steering handle unit 20 is simple in configuration and is therefore resistant to rust caused by salt water or water.

It is to be noted that the present invention is not limited to the embodiment described above. It goes without saying that, in carrying out the invention, suitable modifications can be made to the structures and arrangement of the components of the invention including the locking bar, the groove, the cam groove and the release lever. It should also be understood that various modifications can be made without departing from the spirit of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A steering handle unit of a watercraft to operate a steering cable, the steering handle unit comprising:

a housing attached to a body;

a steering shaft rotatably supported on the housing, the steering shaft having, at a bottom portion thereof, an arm to which the steering cable is connected;

a slide portion which is attached to the steering shaft and which has, at a top portion thereof, a handlebar attachment portion, the handlebar attachment portion being translatable in an axial direction of the steering shaft;

a rotation regulating groove provided on an outer peripheral surface of the steering shaft along the axial direction of the steering shaft;

a rotation regulating portion which is provided on an inner peripheral side of the slide portion and which engages with the rotation regulating groove, the rotation regulating portion regulating rotation of the slide portion around a central axis of the steering shaft and allowing the slide portion to axially translate along the rotation regulating groove;

a plurality of recesses provided in the outer peripheral surface of the steering shaft;

a lock component which is provided in the slide portion and which is removably fitted into a recess to regulate the axial translation of the steering shaft and the slide portion;

a link portion having the lock component disposed at one end thereof;

a release lever disposed opposite to the lock component in the link portion; and a lock mechanism which interlocks the link portion with an operation of the release lever to pull the lock component in and out of the recess, wherein the plurality of recesses are provided along the axial direction of the steering shaft, and the lock component is fitted into one of the plurality of provided recesses to regulate the axial translation of the slide portion at a position corresponding to the recess.

2. The unit according to claim 1, wherein the link portion includes:

a first link bar having one end fixed and connected to the lock component;

a second link bar having both ends connected to the other end of the first link bar and an end of the release lever, respectively;

a first insertion shaft which is inserted through the other end of the first link bar and one end of the second link bar and which turnably connects these ends together;

a cam plate fixed to the slide portion;

a cam groove comprising a curved hole provided in the cam plate and through which the first insertion shaft is inserted;

a second insertion shaft which is inserted through the other end of the second link bar and the end of the release lever and which turnably connects these ends together; and a lever insertion shaft which is inserted through the release lever and which turnably supports the release lever, wherein in the link portion having the lock component fitted in the recess, the second insertion shaft is provided closer to the central axis of the steering shaft than the first insertion shaft and the lever insertion shaft, and wherein the cam groove includes:

a fixing position at which the first insertion shaft is located when the lock component is fitted in the recess; and a releasing position at which the first insertion shaft is located when the lock component is completely pulled out of the recess, and wherein a track between the fixing position and the releasing position has a shape which protrudes toward the central axis of the steering shaft or a shape which translates in parallel with the central axis of the steering shaft and then continues to the releasing position, whereby the lock component is moveable by the operation of the release lever.

3. The unit according to claim 2, wherein:

the lock component comprises a locking bar, the recess is shaped so that the lock component provided perpendicularly to the central axis of the steering shaft is fittable into the recess, and when the lock component is fitted in the recess, the axial translation of the slide portion is regulated by a peripheral surface portion of the lock component.

* * * * *